US005522165A

United States Patent [19]

Molla

[11] Patent Number: 5,522,165

[45] Date of Patent: Jun. 4, 1996

[54] BANNER CONSTRUCTION AND MOUNTING MEANS THEREFOR

[76] Inventor: Roger Molla, 2671 rue Principale, Wendover, Ontario, Canada, K0A 3A0

[21] Appl. No.: 342,039

[22] Filed: Nov. 17, 1994

Related U.S. Application Data

[63] Continuation-in-part of Ser. No. 136,031, Oct. 14, 1993, abandoned.

[51] Int. Cl.[6] ..... G09F 17/00

[52] U.S. Cl. ..... 40/604; 40/617

[58] Field of Search ..... 40/603, 604, 617; 160/327, 328, 329, 354, 368.1, 387, 390; 38/102, 102.1, 102.91

[56] References Cited

U.S. PATENT DOCUMENTS

| | | | |
|---|---|---|---|
| 2,069,600 | 2/1937 | Coleman . | |
| 2,177,327 | 10/1939 | Oberlin . | |
| 2,252,764 | 8/1941 | Farrell . | |
| 2,609,043 | 9/1952 | Dubinsky | 160/390 X |
| 2,911,746 | 11/1959 | Frey . | |
| 2,960,785 | 11/1960 | Kies . | |
| 3,089,268 | 5/1963 | Frey et al. . | |
| 4,906,503 | 3/1990 | De La Cruz et al. . | |

*Primary Examiner*—Brian K. Green
*Attorney, Agent, or Firm*—Kent & Edgar

[57] ABSTRACT

A banner construction for securing to an anchor. The construction comprises a banner made of a predetermined material of rectangular shape having four corners. A rigid plastic sheet having opposite faces is enveloped within the material at each corner. The opposite faces are secured to the material with adhesives so as to form an integral corner section. Aligned apertures through the material and sheet are provided at each corner. Resilient shock absorbers means are releasably securable to the apertures at each corner.

9 Claims, 2 Drawing Sheets

BANNER CONSTRUCTION AND MOUNTING MEANS THEREFOR

The present application is a continuation-in-part of application Ser. No. 08/136,031 filed Oct. 14, 1993, now abandoned.

BACKGROUND OF THE INVENTION

The present invention relates to a construction for mounting a banner, and more particularly to such a construction for spreading and holding taut a banner made of a predetermined material.

Banners, for displaying advertising or other information, usually take the form of an elongated rectangular strip which is secured, at its corners, to an anchor means such as posts through the use of cables secured to such banner. Such banners are usually displayed in an outdoor setting, and hence are subjected to wind and other conditions of air turbulence. In order to reduce the wind resistance of such banners, often unsightly holes are placed through the body of the banner. Such holes often interfere with the visibility of reading matter on the banner. As well, such banners tend to sag and erase when exposed to wind, reducing their attractiveness and readability.

Another problem with such banners, when suspended, is that they tend to sag and wrinkle, again detracting from the attractiveness of such a banner and the readability of any message or the like printed on it. Even the use of a wire or cord edge in the banner to minimize such sagging or wrinkling does not give the banner a rigid appearance or durability.

U.S. Pat. No. 2,911,746 of Frey issued Nov. 10, 1959, teaches a rectangular banner having a rigid member extending through a hem at each end. The banner is suspended, at each end, by a pair of chains, one extending from each corner and both, secured to a third chain spring mounted to a post. Such a construction would be unsuitable for outdoor displays since, in a wind the banner would tend to turn like a wheel about the axis of the third chains.

U.S. Pat. No. 4,906,503 of De La Cruz, et al issued Mar. 6, 1990 teaches a banner of a non-woven polyolefin film-fibril sheet having plastic clamps at the corners to receive corner supporting elastic cords. The plastic clamps tend to either tear the corners or come loose when the banner is subjected to wind forces, making this banner unsuitable for long term outdoor use.

Other banner mounting constructions of general background interest are described and illustrated in U.S. Pat. No. 2,252,764 of Farrell issued Aug. 19, 1941, U.S. Pat. No. 2,177,327 of Oberlin issued Oct. 24, 1939, U.S. Pat. No. 2,960,785 of Kies issued Nov. 22, 1960, U.S. Pat. No. 3,089,268 of Frey et al issued May 13, 1963 and U.S. Pat. No. 2,069,600 of Coleman issued Feb. 2, 1937.

It is an object of the present invention to provide a banner mounting construction which will result in a banner having rigid appearance. It is a further object of the present invention to provide such a construction which will be extremely durable and which will respond well to the forces generated by strong winds and other turbulence.

SUMMARY OF THE INVENTION

In accordance with the present invention, there is provided a banner construction for securing to anchor means, comprising a banner made of a predetermined material of rectangular shape having four corners and a rigid plastic sheet enveloped within the material at each corner. The sheet has opposite faces which are secured, by adhesive means, to the material so as to be integral therewith so as to form an integral corner section of the banner. Aligned apertures pass through the material and sheet at each corner. Resilient shock absorbing means are releasably securable to the apertures at each corner.

In a preferred embodiment of the invention, a plurality of spaced grommets are provided in each of these corners, providing the apertures for securing the resilient shock absorbing means to the banner at that corner.

The construction according to the present invention provides a sturdy banner which resists tearing when subjected to strong winds or air turbulence, while at the same time permitting the banner to be spread and held taut, to give a rigid, planar appearance.

BRIEF DESCRIPTION OF THE DRAWINGS

These and other objects and advantages of the invention will become apparent upon reading the following detailed description and upon referring to the drawings in which.

Figure 1:
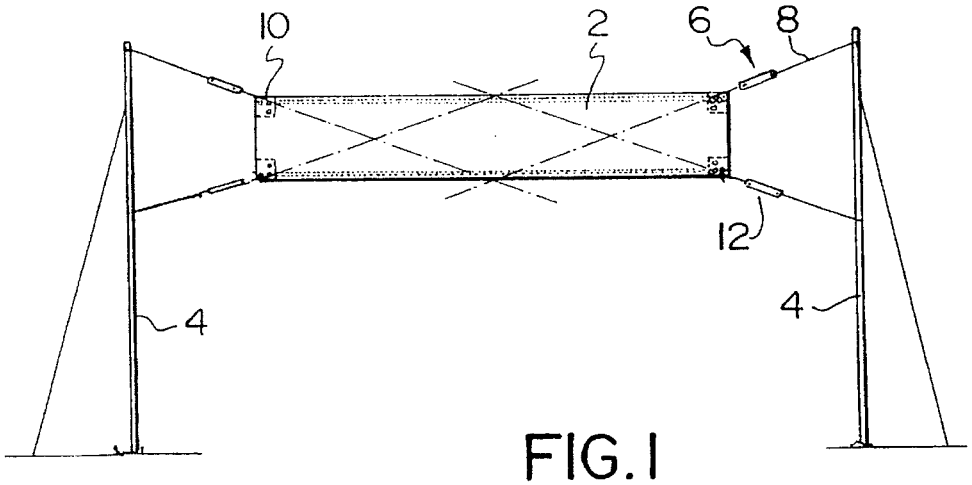
FIG. 1 is a front elevation view of a banner in accordance with the present invention mounted to two posts.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the drawings, similar features have been given similar reference numerals.

Turning to the drawings there is illustrated in FIG. 1 a banner 2 mounted on extension posts 4 with a mounting construction 6 in accordance with the present invention. (While the banner 2 is shown as being mounted to posts 4, any other form of mounting, such as parts of an existing fence or building face, may form the anchor means.)

The banner 2, itself, may be of any particular shape — as illustrated it is of elongated rectangular shape — and of any material such as, for example, polyester with a vinyl laminated facing.

Figure 2:
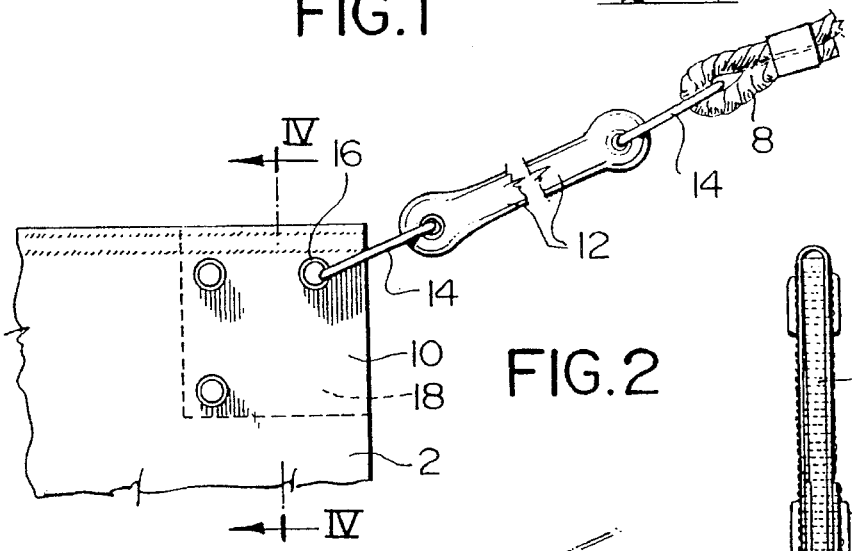
FIG. 2 is an enlarged front view of a corner of the banner of FIG. 1.
Figure 4:
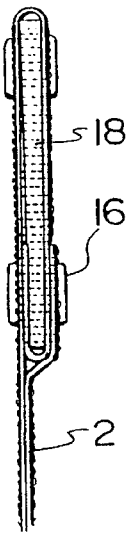
FIG. 4 is a section view along lines IV—IV of FIG. 2.

While conventional cable means or rope 8 may be used for the purpose of securing the four corners 10 of the banner 2 to post 4, between each cable means 8 and that corner 10 is releasably secured a bungee cord 12 as illustrated. Preferably, as illustrated, releasable hooks 14 extend between, at the one end, bungee cord 12 and a corresponding corner 10 of banner 2, and at the other end between bungee cord 12 and cable 8. In practice, two or more of bungee cords 12 are fastened, in this manner, to each corner 10. In this manner, should one cord for some reason fail or break, another cord remains to secure that corner. Hooks 14 extend through an appropriate one of a plurality of grommets 16 in each corner 10. As can be seen in FIGS. 2 and 4, to prevent ripping of the ends of banner 2 and resist the pressures exerted by bungee 12 on those corners, a piece 18 of rigid plastic is sandwiched or otherwise enveloped between the fabric at that corner. (Grommets 16 also extend through this piece 18 of plastic.) As well, by having a plurality of grommets 16 in each corner, adjustment of the positioning and tensioning of the banner by arrangement of the bungee cords 12 in appropriate grommets 16 in the corners can be achieved.

The incorporating of rigid plastic piece 18 as an integral part of each corner is an important part of the construction of banner 2, enabling that banner to withstand tremendous pressure from bungee cords 12 outwardly from the corners, so that the banner can be held tautly. This construction also minimizes the likelihood of tearing of the banners at their corners. Plastic piece 18 is provided with rounded internal corners 20, and has its edges 18 rounded so as to provide no sharp points or edges which would otherwise cut or tear the fabric of banner 2 when that fabric is temporarily bent or creased, for instance when the banner is subjected to the force of a sudden wind. In construction, as illustrated in FIGS. *5a, 5b, 5c* and *5d,* piece 18 is positioned, using two-way tape (not shown) on the bottom side, at a location slightly inset from the edges of the corner, at a greater distance (about two inches) from the shorter edge of the banner (unless the banner is of square configuration). Two-way tape 24 is secured along that shorter edge, and that edge is then folded over to be positioned over piece 18. Vinyl cement is then applied to the upper side of piece 18 (except where it is secured to two-way tape 24), and over the upper surface of fold 26 and a portion 28 of the exposed surface on which piece 18 is placed (FIG. *5b*). A further fold 30 is made in the banner fabric, along this shorter length, to secure the fabric with the vinyl cement in folded position, enveloping the piece 18 as illustrated. A further strip 32 of banner material (eg. polyester with a vinyl laminated facing) is positioned as illustrated, and bonded with an appropriate vinyl glue over fold edge 34, so that corner 10 becomes an integral, unitary, reinforced section incorporating piece 18. The elongated edge 36 is preferably stitched for further reinforcement.

It is further preferred that bungee cords 12 be angled, from each corner, when in anchored position, so that the corner is pulled diagonally away with, as much as possible, the forces exerted by bungee cords 12 being evenly distributed throughout banner 2.

Figure 3:
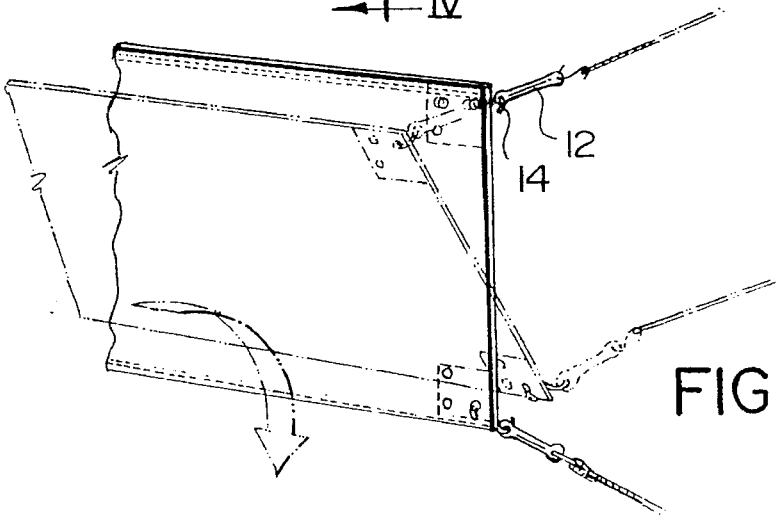
FIG. 3 is a front elevation partial view of the banner of FIG. 1.
Figure 5A:
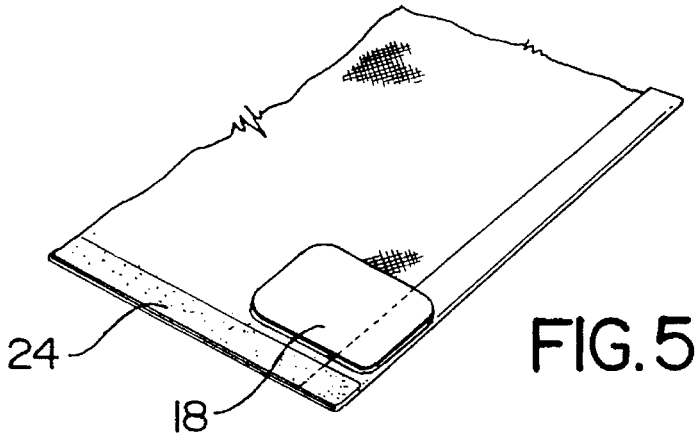
FIGS. 5*a*, 5*b*, 5*c* and 5*d* are schematic, partial views of a corner section of the banner of FIG. 1, illustrating the steps of construction.
Figure 5B:
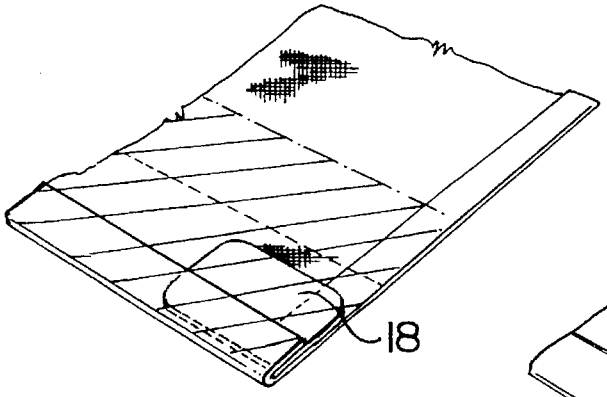
Figure 5D:
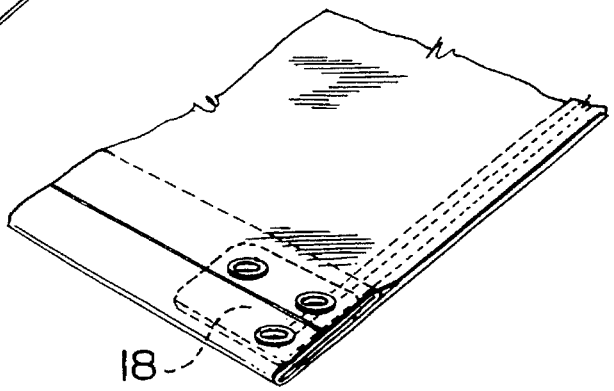
Figure 5C:
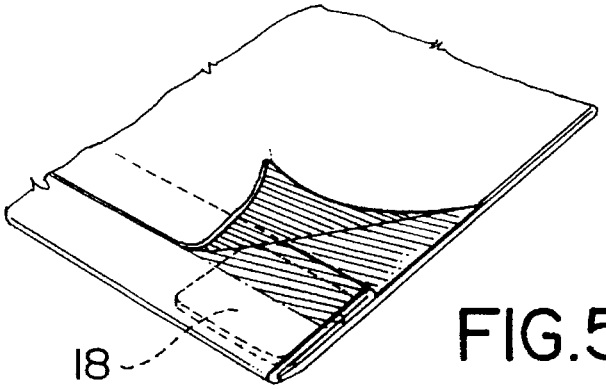

Using the construction of the present invention, when banner 2 is blown by a strong wind or the like, bungee cords 12 permit the entire banner to deflect, as illustrated in FIG. 3, to enable the wind to spill off of the banner and thereby reduce the wind pressure exerted thereon, which the banner remains open, taut and visible in the normal direction. At the same time, the elasticity provided by bungee cords 12, when in position as illustrated, will spread and hold taut the banner 2 so that it has the appearance of for example a rigid board sign.

Thus it is apparent that there has been provided in accordance with the invention a banner construction and mounting means therefor that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A banner construction for securing to anchor means, comprising a banner made of a predetermined material of rectangular shape having four corners, a rigid plastic sheet in each of the corners having opposite faces enveloped within the material of rectangular shade at each corner, the opposite faces secured to the material of rectangular shape with adhesive means so as to form an integral corner section, aligned apertures through the material and sheet at each corner, and resilient shock-absorbing means releasably secured to the apertures at each corner.

2. A banner construction according to claim 1 wherein a plurality of spaced grommets are provided in each of the corners, providing apertures through the material of rectangular shape and plastic sheet to provide alternative locations for securing each bungee cord to the banner at that corner.

3. A banner construction according to claim 1 wherein the shock-absorbing means is a bungee cord.

4. A banner construction according to claim 3 wherein each end of the bungee cord is provided with hook means for releasably securing either to a cable means or to the banner.

5. A banner construction according to claim 1 wherein the banner is of synthetic material with an inter woven polyester inner core and a vinyl laminated facing.

6. A banner construction according to claim 5 wherein the adhesive means comprises a layer of vinyl cement over the plastic sheet, the plastic sheet wrapped between and enveloped by portions of the material of rectangular shape to provide an integral corner section of the banner.

7. A banner construction according to claim 1 wherein the banner is elongated and has a pair of shorter sides and a pair of longer sides, and wherein the shorter sides are folded back over the plastic sheets at each corner and secured by adhesive means to reinforce the banner at each of these corners.

8. A banner construction according to claim 7 wherein the banner is of synthetic material with an inter woven polyester inner core and a vinyl laminated facing.

9. A banner construction according to claim 8 wherein the adhesive means comprises a layer of vinyl cement over the sheet and co-extensive therewith, the plastic sheet wrapped between and enveloped by portions of the material of rectangular shape to provide an integral corner section of the banner.

* * * * *